US006159021A

United States Patent [19]

Kusuhara

[11] Patent Number: 6,159,021

[45] **Date of Patent: *Dec. 12, 2000**

[54] ELECTRICAL CONNECTOR FOR PRINTED CIRCUIT BOARDS

[75] Inventor: Toshitaka Kusuhara, Yokohama, Japan

[73] Assignee: The Whitaker Corporation, Wilmington, Del.

[ * ] Notice: This patent issued on a continued prosecution application filed under 37 CFR 1.53(d), and is subject to the twenty year patent term provisions of 35 U.S.C. 154(a)(2).

[21] Appl. No.: 08/860,500

[22] PCT Filed: Dec. 15, 1995

[86] PCT No.: PCT/US95/16465

§ 371 Date: Jun. 27, 1997

§ 102(e) Date: Jun. 27, 1997

[87] PCT Pub. No.: WO96/24969

PCT Pub. Date: Aug. 15, 1996

[30] Foreign Application Priority Data

Feb. 9, 1995 [JP] Japan ..... 7-021737

[51] Int. Cl.[7] ..... H01R 9/09

[52] U.S. Cl. ..... 439/74; 439/862

[58] Field of Search ..... 439/74, 861, 862, 439/637

[56] References Cited

U.S. PATENT DOCUMENTS

| | | | |
|---|---|---|---|
| 3,975,076 | 8/1976 | Shida et al. | 439/62 |
| 4,632,478 | 12/1986 | Kozai et al. | 339/17 LC |
| 4,737,120 | 4/1988 | Grabbe et al. | 439/326 |
| 5,009,606 | 4/1991 | Villeneuve et al. | 439/59 |
| 5,199,884 | 4/1993 | Kaufman et al. | 439/74 |
| 5,224,866 | 7/1993 | Nakamura et al. | 439/81 |
| 5,263,870 | 11/1993 | Billman et al. | 439/108 |
| 5,626,482 | 5/1997 | Chan et al. | 439/74 |

FOREIGN PATENT DOCUMENTS

| | | | |
|---|---|---|---|
| 4-116375 | of 1992 | Japan | H01R 13/11 |

OTHER PUBLICATIONS

International Search Report; 50802PCT; International Application No.: PCT/US95/16465; International Filing Date Dec. 15, 1995.

Copies were Already Included in the International Search Report.

*Primary Examiner*—Steven L. Stephan
*Assistant Examiner*—T C Patel

[57] ABSTRACT

The object of the present invention is to provide an electrical connector which makes it possible for the contacts to electrically contact each other with a high contact pressure even when the contacts are made smaller and shorter. Contacts (40) and (80) which electrically contact each other are respectively secured in housings of a plug connector (20) and a cap connector (60), with the contacts being positioned in two rows in each connector. When the plug connector (20) and cap connector (60) are connected, first and second spring members (42) and (44) of the contacts (40) are clamped between wall surfaces **(38*a*) and (38*b*) of the housing (30) and contact section (82) of the contacts (80), so that the contacts (40) and (80)** are springably pressed strongly against each other.

9 Claims, 8 Drawing Sheets

ELECTRICAL CONNECTOR FOR PRINTED CIRCUIT BOARDS

FIELD OF THE INVENTION

The present invention concerns an electrical connector equipped with two connector halves that are respectively mounted on different boards and connect these boards to each other.

BACKGROUND OF THE INVENTION

In the past, electrical connectors have been widely used in order to connect printed circuit boards, hereafter referred to as "PCB's", to each other. Such electrical connectors as disclosed in U.S. Pat. No. 5,224,866 are equipped with a plug connector and a cap connector that are mounted on different boards and are connected to each other. The PCB's are connected to each other by connecting the plug connector and cap connector. The plug connector and cap connector each have a plurality of contacts and a housing in which these contacts are lined up at a given pitch. Ordinarily, the contacts lined up in the housing of the plug connector possess spring forces, so that when the plug connector and cap connector are connected, the contacts lined up in the respective housings are caused to contact each other with a given force as a result of these spring forces, thus establishing an electrical connection.

As a result of the miniaturization of electrical connectors in recent years, there has been a tendency for the contacts to become smaller and for the pitch at which the contacts are lined up to become narrower. Furthermore, there has also been a tendency for the contacts to become shorter, in order to reduce the distance between the connected boards when the boards are connected face-to-face by such an electrical connector. In cases where the contacts are thus made smaller and shorter, the spring forces of the contacts drops so that there is a drop in the contact pressure between the contacts, thus leading to the danger of an inadequate electrical connection.

U.S. Pat. No. 5,224,866 discloses an electrical connector assembly for electrical connection to conductive pads on board members including plug and receptacle connectors. Each connector has electrical terminals secured in a housing, the terminals including contact sections and termination sections for electrical connection to the conductive pads on one of the board members. The terminals in the receptacle or cap connector have a linear configuration secured in the housing and include contact sections for electrically connecting with the contact sections of the plug connector when the plug connector and receptacle connector are mated together.

The object of the present invention is to provide an electrical connector that makes it possible to cause the respective terminals or contacts to electrically and mechanically engage each other with a high contact pressure even if the contacts are made smaller or shorter.

The electrical connector of the present invention, which is used in order to achieve the above mentioned object, is an electrical connector that is equipped with a plug connector and a cap connector in which the plug of first contacts and the cap or second contacts that contact each other are respectively aligned. The connectors are respectively mounted on a first board and a second board and connect the first board and second board to each other.

The electrical connector for electrical connection to conductive pads on board members comprises a plug connector having first electrical contacts secure din a plug housing and including contact sections and termination sections for electrical connection to the conductive pads on one of the board members and a cap connector having second electrical contacts with a linear configuration secured in a cap housing and including contact sections electrically connecting with the contact sections of the plug connector when the plug connector and cap connector are mated together and termination sections for electrically connecting with the conductive pads of the other of the board members. The connector is characterized in that: each contact of the plug connector includes a base portion having a beam extending upwardly therefrom, the beam including a contact section thereon for mating with a corresponding linear contact of the cap connector. The beam further includes an S-shaped spring portion extending from the end thereof, the spring portion extending to an end portion that is substantially at the same height as the contact section on the upstanding beam. Upon mating the plug and cap connectors, the spring end portion presses against a central wall of the plug connector such that the S-shape contact sections of the plug connector are springably clamped between the linear contact sections of the cap connector and the wall of the plug housing.

As a result, even if the contacts are made smaller and shorter in order to reduce the pitch of the contacts, the first or plug contacts and second or cap contacts can be caused to wipingly contact each other with a high contact pressure. Furthermore, the first contacts are lined up in two rows so that the S-shaped spring members are mutually symmetrical in the opposing rows. As a result, the respective forces from the wall surfaces and the second contacts are balanced between the two rows, so that the first contacts and second contacts can be caused to contact each other with a high well-balanced contact pressure. Thus, an electrical connector that provides a secure electrical connection can be obtained.

Embodiments of the electrical connector of the present invention will now be described by way of example with reference to the accompanying drawings.

BRIEF DESCRIPTION OF DRAWINGS

FIG. 1 is a plan view, FIG. 2 is a side view, FIG. 3 is an end view, and FIG. 4 is a schematic plan view of a board on which the plug connector is mounted.

FIG. 6 is a plan view, FIG. 7 is a side view, FIG. 8 is an end view, and FIG. 9 is a schematic plan view of a board on which the cap connector is mounted.

FIG. 12 is a plant view, FIG. 13 is a side view, and FIG. 14 is an end view.

DETAILED DESCRIPTION OF EMBODIMENTS OF THE INVENTION

A first embodiment of the electrical connector of the present invention will be described with reference to FIGS. 1 through 11.

Figure 11:
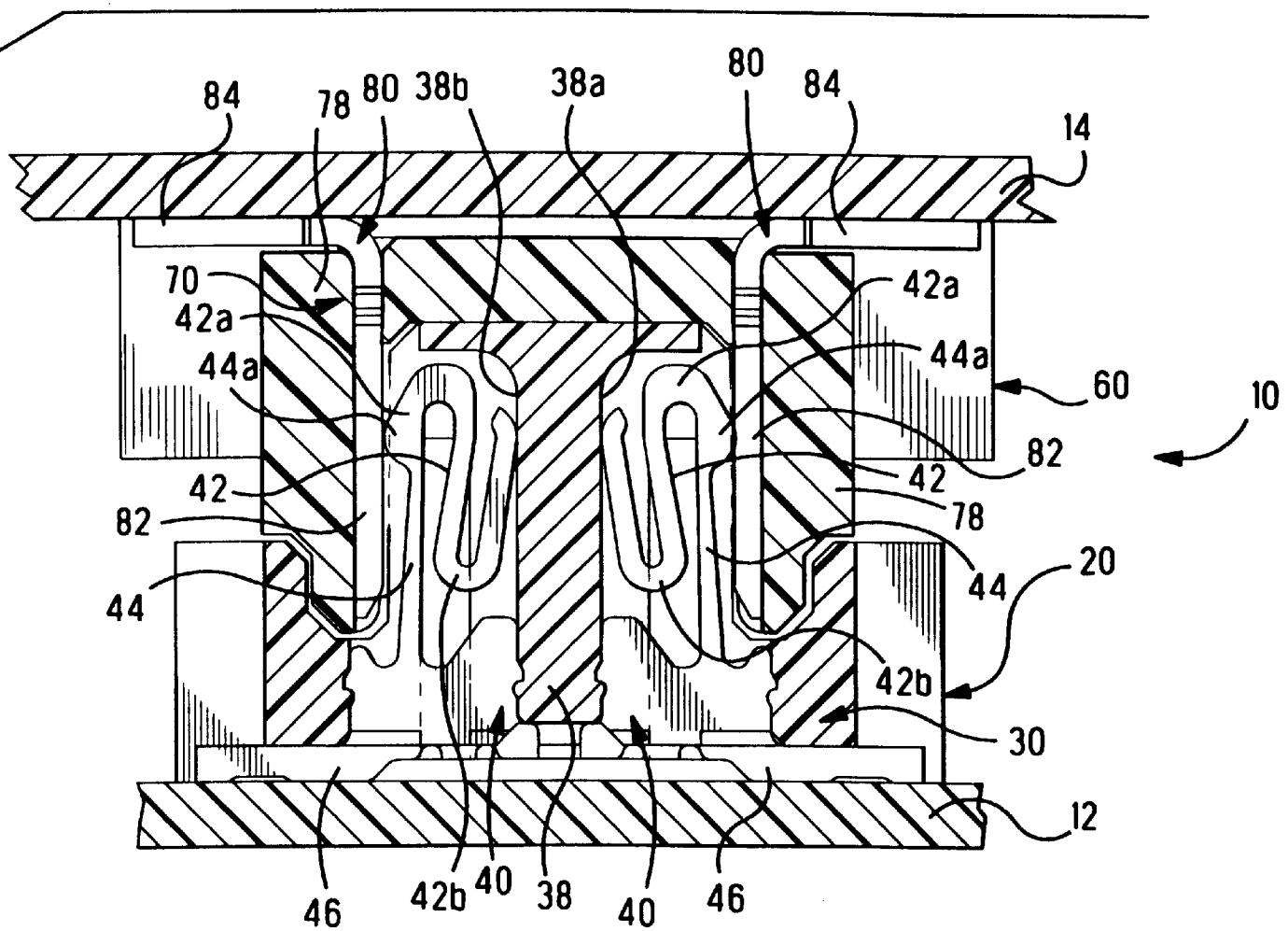
FIG. 11 is a cross-sectional view that illustrates the connected state of the plug connector shown in FIGS. 1–4 and the cap connector shown in FIGS. 6–9.
Figure 14:
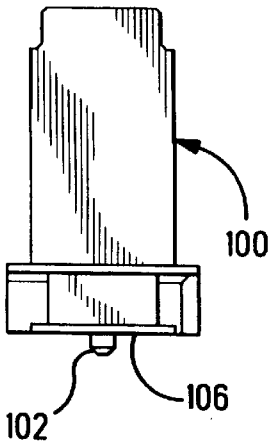
FIGS. 12–14 illustrate the cap connector in a second embodiment of the electrical connector of the present invention.
Figure 12:
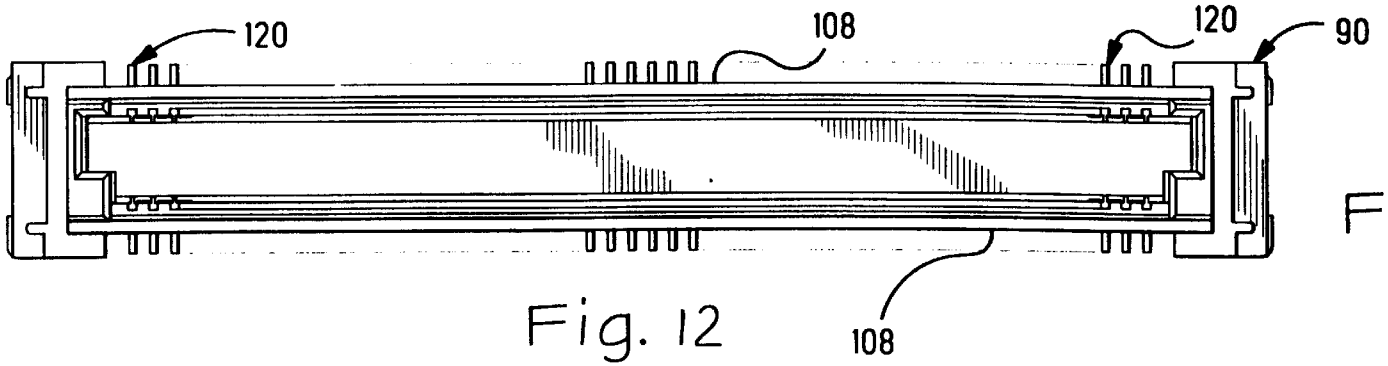
Figure 13:
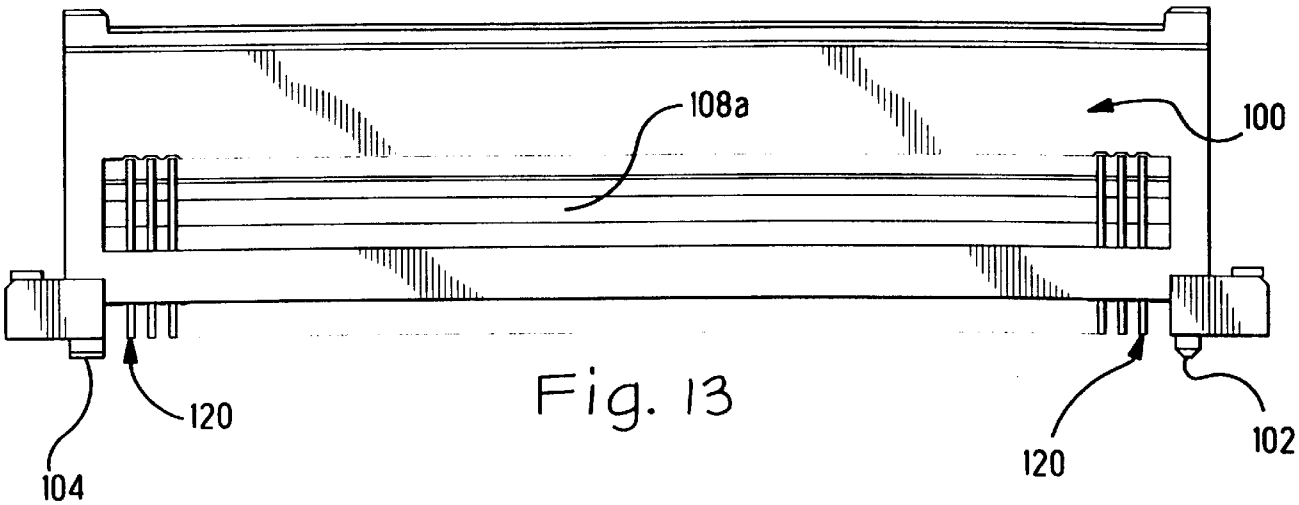

FIGS. 1–5 illustrate the plug connector of the electrical connector. A plug connector is one example of the connector referred to as the "first connector" in the present invention. FIGS. 6–10 illustrate the cap connector. A cap connector is one example of the connector referred to as the "second connector" in the present invention. FIG. 11 shows the plug connector and cap connector connected to each other.

The electrical connector 10 (FIG. 11) has a plug connector 20 and a cap connector 60 that are connected to each other. The plug connector 20 is mounted on a board 12, and the cap connector 60 is mounted on a board 14. When the plug connector 20 and cap connector 60 are connected to each other, the boards 12 and 14 are connected to each other face-to-face as shown in FIG. 11.

The plug connector 20 (FIGS. 1–5) is equipped with a housing 30 and contacts 40. The contacts 40 have projections 41, for press fitting into contact-receiving cavities of the housing 30 so as to be fastened to the housing 30, and they are aligned in two rows in the direction of the length of the housing 30. The housing 30 has posts 32 and 34 that are respectively inserted into post holes 12*a*, 12*b* formed in the board 12 and a metal-fastening fitting or hold down 36 that is soldered to a fastening pads 12*c* on the board 12. Furthermore, a central wall 38 that extends in the direction of the length of the housing 30 is formed in the central part of the housing 30. This central wall 28 has two wall surfaces 38*a* and 38*b*. Contacts 40 are comprised of contact sections 41 including S-shaped first spring members 42 that have two bent portions 42*a* and 42*b*, second spring members 44 that have contact projections 44*a* which electrically contact the contact sections 82 of contacts 80 described later, and termination sections 46 that are soldered to conductive pads 12*d* on the board 12. The contact legs 42*c* of the first spring members 42 substantially contact the wall surfaces 38*a* and 38*b*, while the second spring members 44 via contact projections 44*a* contact the contact sections 82 of the contacts 80. The contacts 40 are formed by stamping from single metal plates, which are superior in terms of conductivity and spring characteristics. The contacts 40 are installed at a pitch of 0.6 mm, and the height of the contacts 40 from the board 12 is approximately 3.00 mm.

Figure 3:
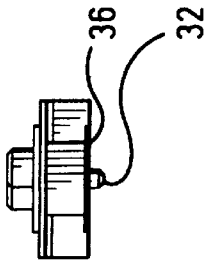
FIGS. 1–4 illustrate the plug connector in a first embodiment of the electrical connector of the present invention.
Figure 1:
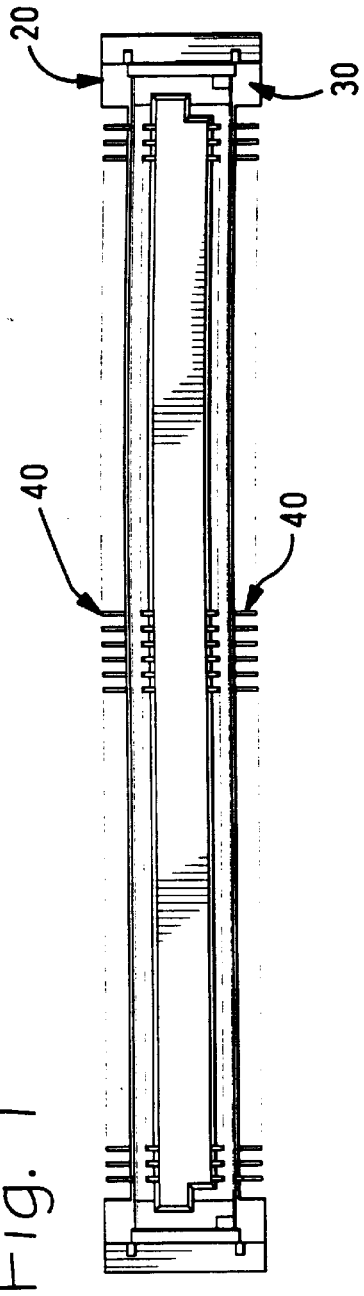
Figure 2:
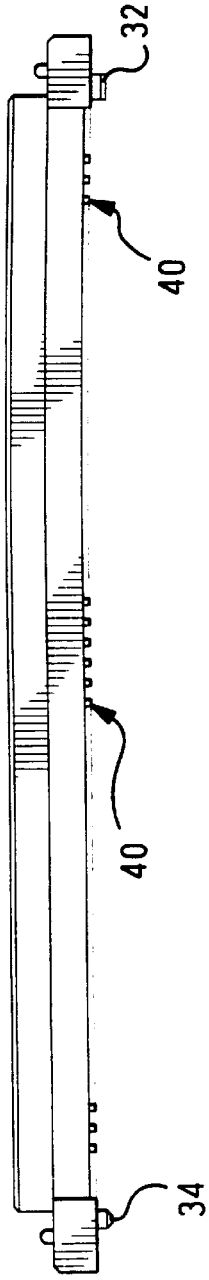
Figure 4:
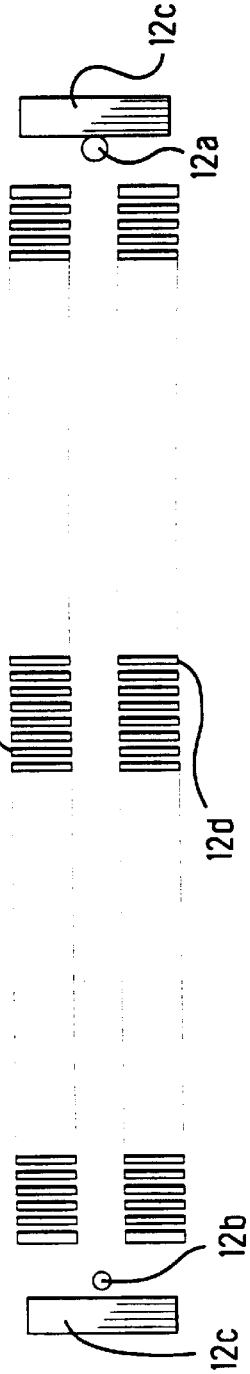
Figure 10:
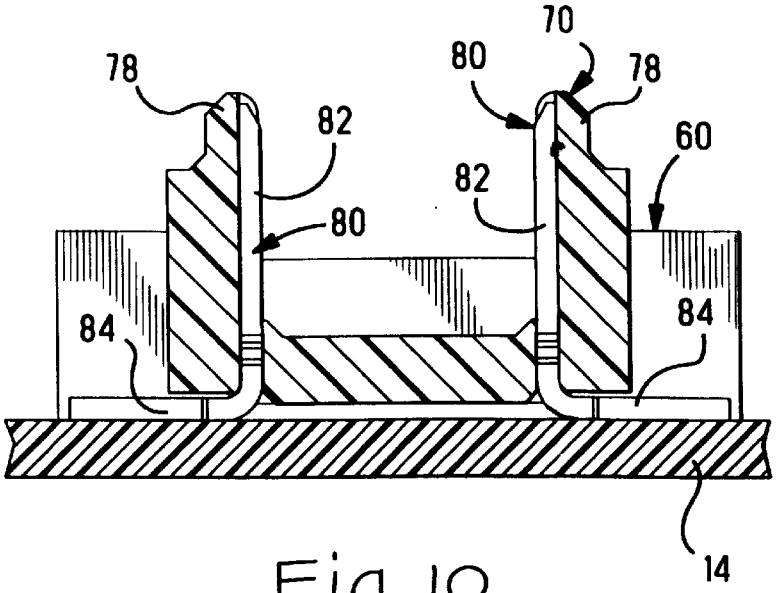
FIG. 10 is a cross-sectional view of the cap connector shown in FIGS. 6–9.
Figure 5:
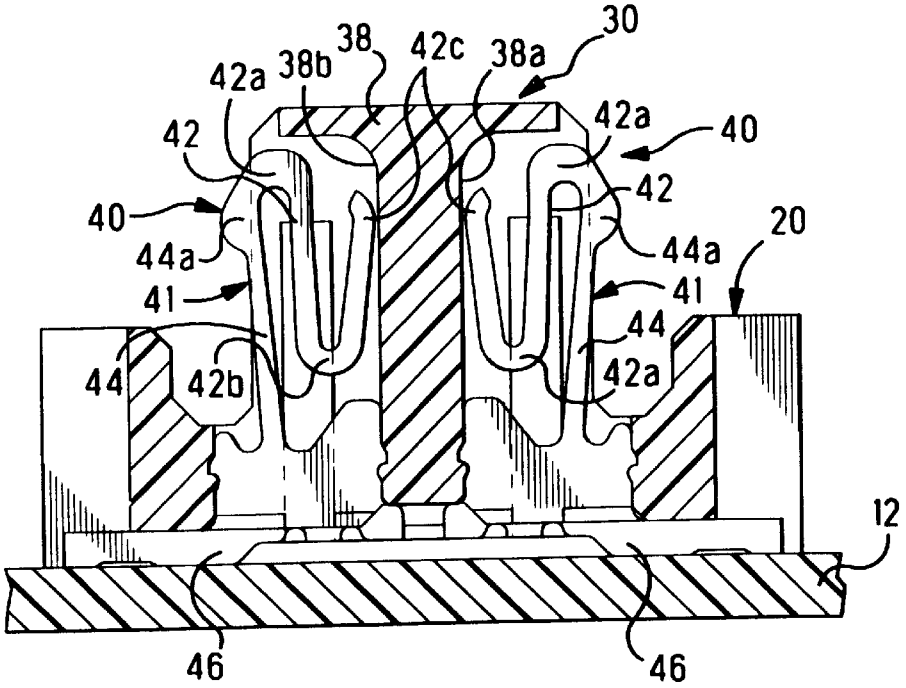
FIG. 5 is a cross-sectional view of the plug connector shown in FIGS. 1–4.
Figure 8:
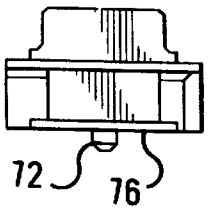
FIGS. 6–9 illustrate the cap connector of the electrical connector of the present invention.
Figure 6:
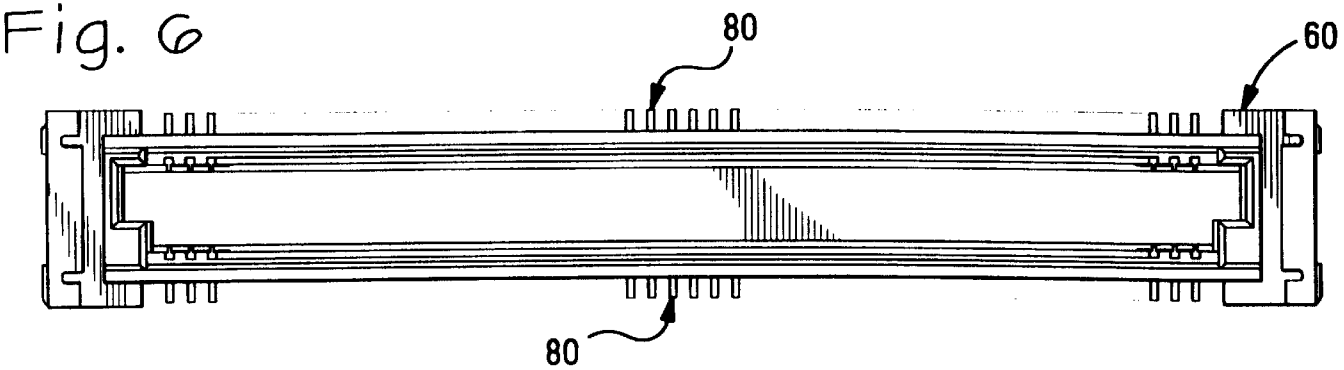
Figure 7:
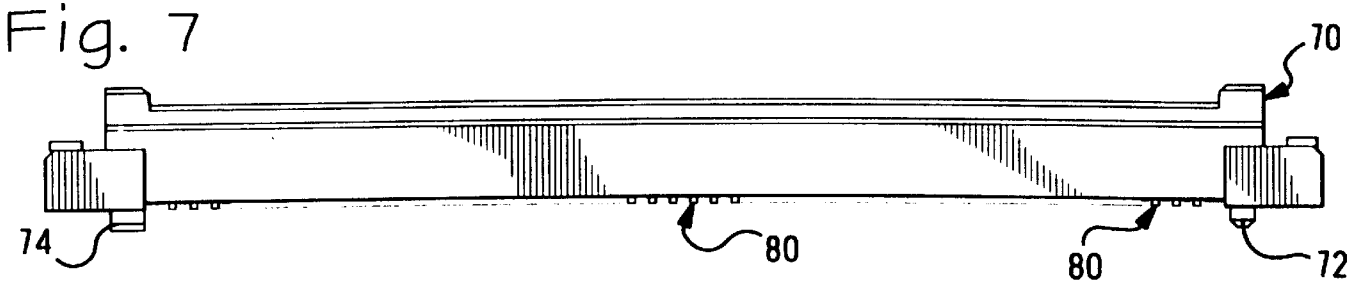
Figure 9:
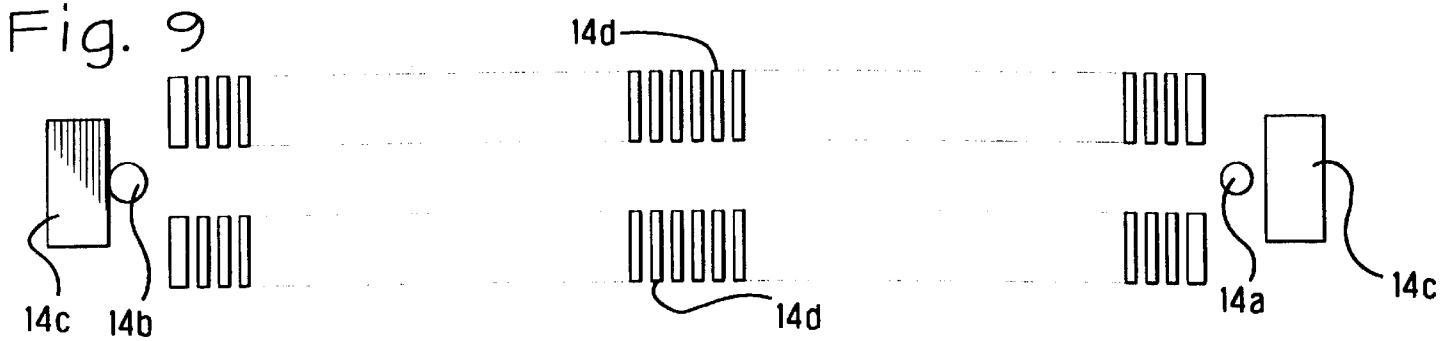

The cap connector 60 is equipped with a housing 70 and contacts 80. The contacts 80 are lined up in two rows along the length of the housing 70. The housing 70 is equipped with posts 72 and 74 as shown in FIG. 7 that are respectively inserted into post holes 14*a* and 14*b* formed in the board 14, and a metal-fastening fitting or hold down 76 that is soldered to a fastening pad 14*c* on the board 14. Furthermore, side walls 78, which extend in the direction of length of the housing 70, are formed on both side portions of the housing 70. Contacts 80 are comprised of contact sections 82 that electrically contact the contact projections 44*a* of the second spring members 44 of the contacts 40 and termination sections 84 that are soldered to conductive pads 14*d* on the board 14. The contacts 80 are formed by stamping and bending single metal plates, which are superior in terms of conductivity and spring characteristics. The contacts 80 are installed at a pitch of 0.6 mm, and the height of the contacts 80 from the board 14 is approximately 3.0 mm.

When the plug connector 20 and cap connector 60 are connected, as shown in FIG. 11, the first and second spring members 42 and 44 of the contacts 40 are clamped between the wall surfaces 38*a* and 38*b* and the contact sections 82 of the contacts 80. Furthermore, when the contact projections 44*a* of the second spring members 44 are pressed against the contact sections 82 of the contacts 80, the first and second spring members 42 and 44 apply a force on the contacts 80. Thus, when the plug connector 20 and cap connector 60 are connected, the contacts 40 are clamped between the wall surfaces 38*a* and 38*b* and the contacts 80 and are strongly pressed against both the wall surfaces 38*a* and 38*b* and contacts 80. Accordingly, even if the contacts 40 are made smaller and shorter in order to reduce the pitch of the contacts 40, the contacts 40 and contacts 80 electrically and wipingly contact each other with a high contact pressure. Furthermore, since the contacts 40 are arranged in two rows so that the first and second spring members 42 and 44 of the contacts 40 are mutually symmetrical in the opposing rows, the respective forces between contacts 40 and 80 are balanced between the rows of contacts 40, so that the contacts 40 and contacts 80 contact each other with a high well-balanced contact pressure, thus making it possible to obtain an electrical connector that provides secure electrical connections.

A second embodiment of the electrical connector of the present invention will be described with reference to FIGS. 12–15:

The electrical connector of the second embodiment is characterized by the shape of the cap connector. The plug connector has the same shape as the plug connector in the first embodiment. Accordingly, the cap connector will be described here.

The cap connector 90 is equipped with a housing 100 and contacts 120. The contacts 120 are lined up in two rows along the length of the housing 100. Compared to the contacts 80 of the cap connector 60 shown in FIGS. 6–9, the contacts 120 are longer with a length of approximately 9.00 mm. The housing 100 is equipped with posts 102 and 104 that are respectively inserted into post holes 14*a* and 14*b* formed in the board 14 and a metal-fastening fitting or hold down 106 that is soldered to a fastening pad 14*c* on the board 14. Furthermore, side walls 108 extend in the direction of the length of the housing 100 and are formed with openings 108*a*. These openings are a characteristic feature of the cap connector 90. The reason for forming the openings 108*a* will be described below.

The housing 100 is ordinarily made of a synthetic resin and is formed by injection molding using a mold that corresponds to the shape of the housing 100. The contacts 120 are inserted into the housing 100 after the housing 100 has been molded. The spaces into which the contacts 120 are inserted are formed in the injection-molded walls of the housing 100 using long, slender pins known as core pins.

After the housing 100 has been injection-molded, these core pins are removed from the housing 100. In cases where the contacts 120 are long, the core pins are also naturally long, so that there is a danger that bending will occur when the core pins are pulled out of the housing 100. Accordingly, the openings 108*a* are formed in the side walls 108 of the housing 100 in order to allow shortening of the core pins even in cases where the contacts 120 are long. By thus forming the openings 108*a,* it is possible to use a metal mold in the areas corresponding to the openings 108*a* during injection molding. Furthermore, two short core pins that are respectively inserted from above and below are used in each area corresponding to a space into which one of the contacts 120 is to be inserted. By thus using two short core pins to form spaces for the insertion of long contacts, it is possible to prevent bending of the core pins when they are pulled out of the housing 100 following injection molding.

Figure 16:
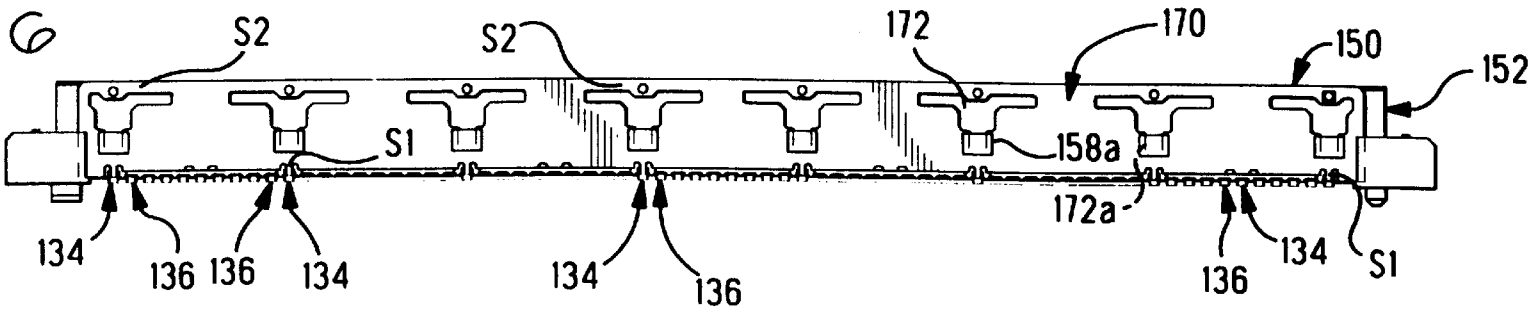
FIG. 16 is a side view that illustrates the cap connector in a third embodiment of the electrical connector of the present invention.
Figure 15:
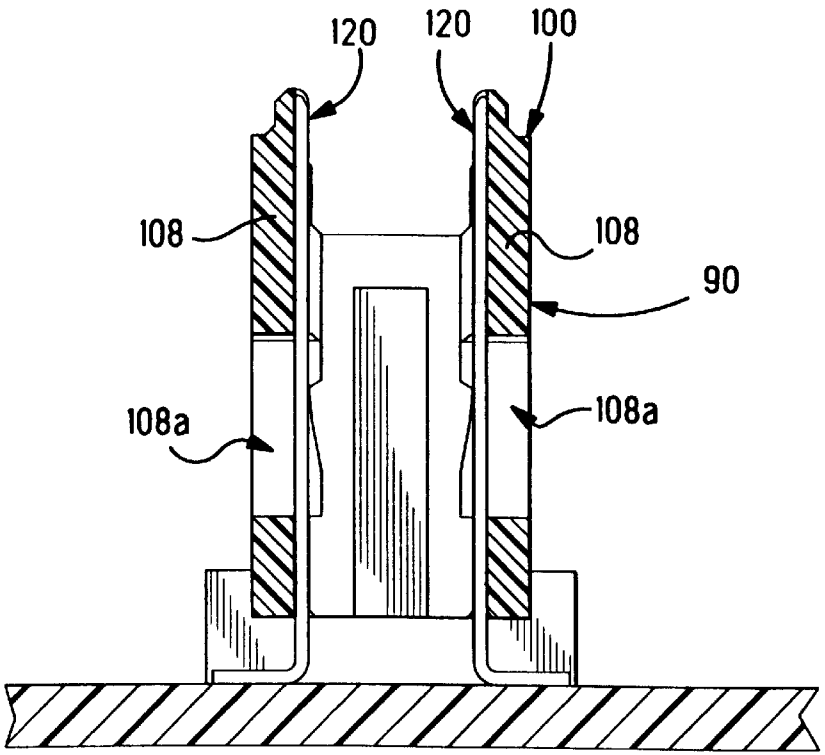
FIG. 15 is a cross-sectional view of the cap connector shown in FIGS. 12–14.
Figure 17:
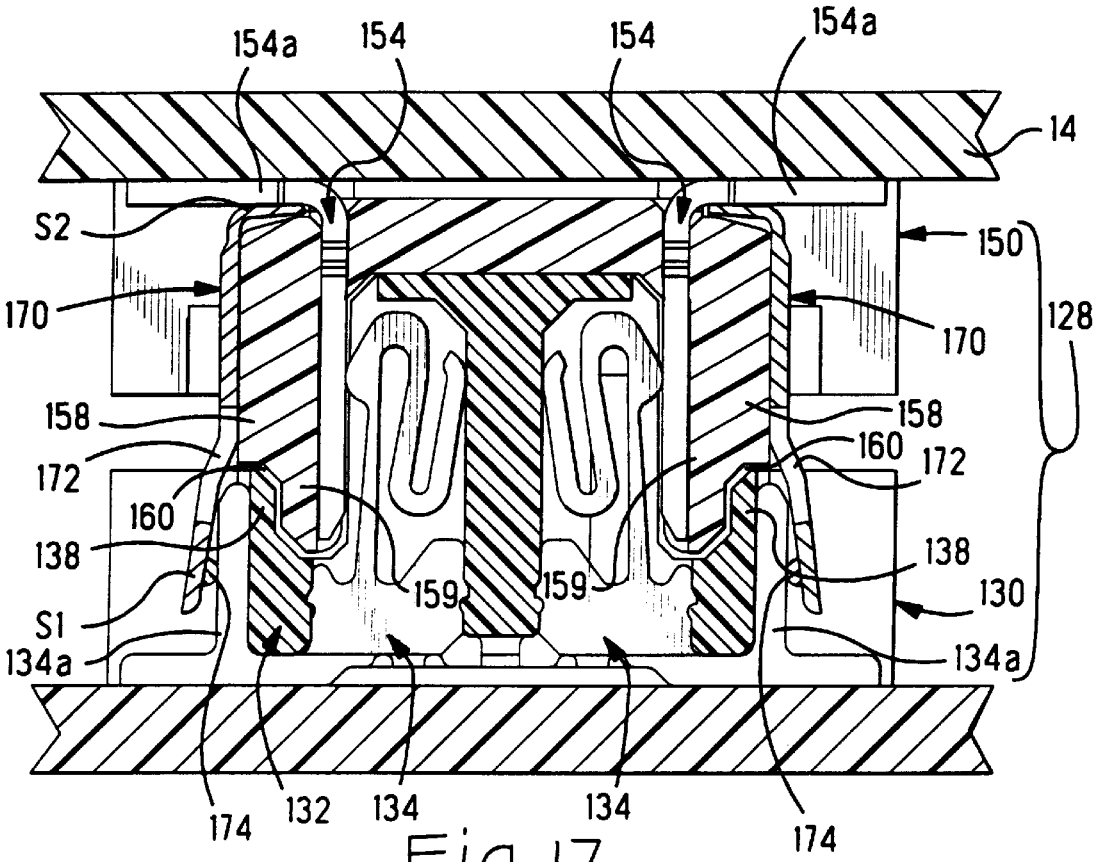
FIG. 17 is a cross-sectional view that shows the cap connector in FIG. 16 connected with a plug connector, illustrating the electrical contact between the ground contacts of the cap connector and the ground contacts of the plug connector.
Figure 18:
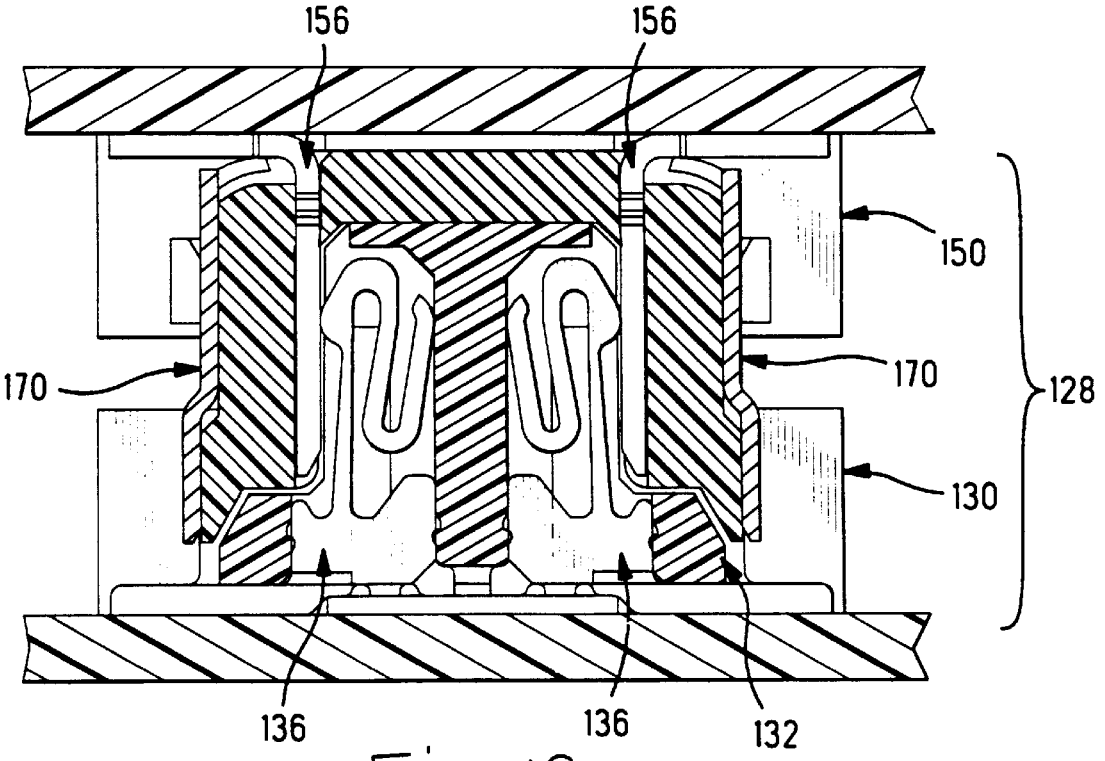
FIG. 18 is a cross-sectional view that shows the cap connector in FIG. 16 connected with a plug connector, illustrating the electrical contact between the signal contacts of the cap connector and the signal contacts of the plug connector.

A third embodiment of the electrical connector of the present invention will be described with reference to FIGS. 16–18.

The electrical connector 128 of the third embodiment is characterized by shield plates 170 that are attached to the side surfaces of walls 158 of the housing 152 of the cap connector 150 and by the shape of the ground contacts among the contacts of the plug connector.

The electrical connector 128 of the third embodiment is equipped with a plug connector 130 and a cap connector 150 that are substantially similar in shape to the plug connector 20 and cap connector 60 of the electrical connector 10 of the first embodiment illustrated in FIGS. 1 through 11. Ground contacts 134 and signal contacts 136 are arranged in the housing 132 of the plug connector 130. Furthermore, ground contacts 154 and signal contacts 156 are also arranged in the housing 152 of the cap connector 150. Moreover, shield plates 170 are respectively attached to both side surfaces of walls 158 of the housing 152 of the cap connector 150. This attachment is accomplished by causing the shield plates 170 to slide relative to the housing 152 so that respective projections 158*a* formed on the side surfaces of walls 158 enter the narrow portions 172*a* of openings 172 formed in the shield plates 170. Bridge contact sections S1 (supported at both ends) on which dimples 174 are formed and tongue members S2, which are used to make spring contact with the ground contacts 154 of the cap connector 150, are formed on the shield plates 170.

When the plug connector 130 and a cap connector 150 are connected, the bridge contact sections S1 of the shield plates 170 contact the extensions 134*a* of the ground contacts 134, and the tongue members S2 springably contact the termination sections 154*a* of the ground contacts 154. If necessary, the tongue members S2 and the termination sections 154*a* of the ground contacts 154 may be soldered. Furthermore, in the assembly process, the termination sections 154*a* of the ground contacts 154 are soldered to the conductive pads 14*d* on board 14. Accordingly, the heat generated when the cap connector 150 is mounted on the board 14 may be utilized in order to solder the tongue members S2 and the termination sections 154*a* of the ground contacts 154. As is shown in FIG. 18, the signal contacts 136 and 156 do not contact the shield plates 170. Furthermore, the housing 152 of the cap connector 150 has projecting portions 159 and grooves 160 that accommodate the projecting portions 138 of housing 132 at which the contact sections S1 and extensions 134*a* are located. The assembly process is as follows: The shield plates 170 are first attached to the housing 152 of the cap connector 150, after which the contacts 154 and 156 are positioned into the housing 152. Soldering is performed only when the cap connector 150 is attached to the board. Dimples 174 are formed in the shield plate 170, and these dimples 174 electrically contact the extensions 134*a* of the ground contacts 134. However, it would also be possible to omit the dimples 174. In the electrical connector of this third embodiment, as was described above, the respective ground contacts 134 and 154 can easily be connected by attaching a single shield plate 170 to the housing 152 of the cap connector 150.

Figure 19:
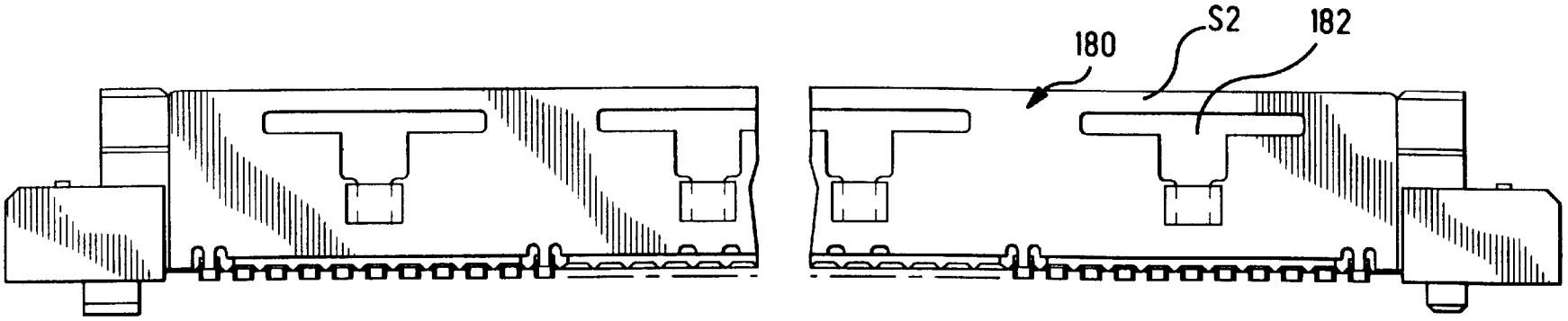
FIG. 19 is a side view that illustrates the cap connector in a fourth embodiment of the electrical connector of the present invention.

FIG. 19 illustrates a fourth embodiment of the electrical connector of the present invention. The difference between this electrical connector and the electrical connector of the third embodiment lies in the shape of the shield plates. In the shield plates 180 of the electrical connector of this fourth embodiment, no projections are formed in the tongue members in order to prevent sagging of the slots 182. An effect similar to that obtained using the shield plates 170 shown in FIG. 16 can also be obtained using these shield plates 180.

In the electrical connector of the present invention, as was described above, the first contacts are clamped between the wall surfaces and the second contacts and are thus strongly pressed against both the wall surfaces and the second contacts, when the first and second connectors are connected to each other. Accordingly, even in cases where the contacts are made smaller and shorter in order to reduce the pitch of the contacts, the first contacts and second contacts can be caused to electrically contact each other with a high contract pressure. Furthermore, since the first contacts are lined up in two rows so that the first and second spring members are mutually symmetrical in the opposing rows, the respective forces from the wall surfaces and the second contacts are balanced between the two rows, so that the first contacts and second contacts can be electrically connected to each other with a high, well-balanced contact pressure, thus making it possible to obtain an electrical connector that provides a secure electrical connection.

I claim:

1. An electrical connector for electrical connection to conductive pads on board members comprising a plug connector having electrical contacts secured in a plug housing and including contact sections and termination sections for electrical connection to the conductive pads on one of the board members and a cap connector having electrical contacts with a linear configuration secured in a cap housing and including contact sections electrically connecting with the contact sections of the plug connector when the plug connector and cap connector are mated together and termination sections for electrically connecting with the conductive pads of the other of the board members, wherein:

each contact of the plug connector includes a base portion having abeam extending upwardly therefrom, the beam including a contact section thereon for mating with a corresponding linear contact of the cap connector, the beam further including a spring portion extending from an end thereof, the spring portion including an arm extending to a curved spring end portion with the arm extending along a central wall of the plug housing;

whereby upon mating the plug and cap connectors, the curved spring end portions press against the central wall of the plug housing such that the spring portions of the contact sections of the plug connector are springably clamped between the linear contact sections of the cap connector and the wall of the plug housing.

2. The electrical connector of claim 1, wherein the base portion of each contact of the plug connector is connected to the termination section.

3. The electrical connector of claim 1, wherein the spring portion has an S-shape and the end portion engages the central wall.

4. The electrical connector of claim 1, wherein shield plates extend along surfaces of the cap housing, and ground contacts are secured in the cap housing and are in electrical connection with the shield plates.

5. The electrical connector of claim 1, wherein the beams have a contact projection that electrically contact the linear contact.

6. An electrical connector having a plug and a cap, the connector comprising:

a plug housing having sidewalls and a central wall therebetween;

a plurality of contacts disposed between the sidewalls and the central wall, each contact including a base portion, the base portion having a beam extending upwardly from the base portion between the sidewalls and the central wall, a contact section disposed on the beam, and a spring portion extending from the beam including an arm having a curved end portion extending along the central wall; and a cap housing having plurality of linear contacts disposed along parallel walls, the linear contacts contacting the beams and compressing the spring portions between the linear contacts and the central wall, and wherein the sidewalls of the plug and the parallel walls of the cap engage each other at free ends when the cap and plug are mated.

7. The electrical connector of claim 6, wherein the beam has contact projections that electrically contact the linear contacts.

8. The electrical connector of claim 6, wherein the spring portion has an S-shape.

9. The electrical connector of claim 6, wherein shield plates extend along surfaces of the cap housing, and ground contacts are secured in the cap housing and are in electrical connection with the shield plates.

* * * * *